US011832648B2

(12) United States Patent
Lee et al.

(10) Patent No.: US 11,832,648 B2
(45) Date of Patent: Dec. 5, 2023

(54) CARTRIDGE FOR AEROSOL GENERATING DEVICE

(71) Applicant: KT&G CORPORATION, Daejeon (KR)

(72) Inventors: Jong Sub Lee, Gyeonggi-do (KR); Dong Bum Kwon, Seoul (KR); Jin Soo Seong, Seoul (KR); Jae Min Lee, Gyeonggi-do (KR)

(73) Assignee: KT&G CORPORATION, Daejeon (KR)

( * ) Notice: Subject to any disclaimer, the term of this patent is extended or adjusted under 35 U.S.C. 154(b) by 603 days.

(21) Appl. No.: 17/043,858

(22) PCT Filed: May 14, 2020

(86) PCT No.: PCT/KR2020/006328
§ 371 (c)(1),
(2) Date: Sep. 30, 2020

(87) PCT Pub. No.: WO2021/020702
PCT Pub. Date: Feb. 4, 2021

(65) Prior Publication Data

US 2023/0128605 A1 Apr. 27, 2023

(30) Foreign Application Priority Data

Jul. 29, 2019 (KR) ..... 10-2019-0092005

(51) Int. Cl.
*A24F 40/42* (2020.01)
*A24F 40/10* (2020.01)
(Continued)

(52) U.S. Cl.
CPC ..... *A24F 40/42* (2020.01); *A24F 40/10* (2020.01); *A24F 40/46* (2020.01); *A24F 40/51* (2020.01)

(58) Field of Classification Search
None
See application file for complete search history.

(56) References Cited

U.S. PATENT DOCUMENTS 10,034,494 B2 7/2018 Ampolini et al.
10,143,239 B2 * 12/2018 Gavrielov ..... H05B 3/42
(Continued)

FOREIGN PATENT DOCUMENTS

CN 206371519 U 8/2017
CN 107734982 A 2/2018
(Continued)

OTHER PUBLICATIONS

Written Opinion for PCT/KR2020/006328, dated Sep. 1, 2020.
(Continued)

*Primary Examiner* — Tho D Ta
(74) *Attorney, Agent, or Firm* — Sughrue Mion, PLLC

(57) ABSTRACT

A cartridge for an aerosol generating device includes a cartridge for an aerosol generating device includes a liquid storage provided with a space storing a liquid composition that is atomized by a heater to generate an aerosol and including an open end portion of one side sealed by a sealing means to prevent leakage of the liquid composition stored in the space; a mouthpiece coupled in a direction covering the open end portion of the liquid storage and including a discharge hole through which the aerosol generated from the liquid composition stored in the liquid storage is discharged to an outside; and a flavor capsule provided in a space between the open end portion of the one side of the liquid storage hidden by coupling of the liquid storage and the mouthpiece and the sealing means and crushed due to pressure from a user to discharge a flavoring agent.

8 Claims, 5 Drawing Sheets

(51) Int. Cl.
*A24F 40/46* (2020.01)
*A24F 40/51* (2020.01)

(56) References Cited

U.S. PATENT DOCUMENTS

| | | | | |
|---|---|---|---|---|
| 10,328,443 | B2 | 6/2019 | Ricketts et al. | |
| 10,595,559 | B2 | 3/2020 | Besso | |
| 2015/0027469 | A1 | 1/2015 | Tucker et al. | |
| 2017/0006917 | A1* | 1/2017 | Alvarez | A24F 40/42 |
| 2017/0150753 | A1* | 6/2017 | Macko | H05B 1/0244 |
| 2017/0215485 | A1 | 8/2017 | Zitzke | |
| 2017/0251723 | A1 | 9/2017 | Kobal et al. | |
| 2018/0169355 | A1 | 6/2018 | Reevell | |
| 2018/0297048 | A1 | 10/2018 | Ricketts et al. | |
| 2018/0325174 | A1* | 11/2018 | Sutton | A24B 9/00 |
| 2018/0325182 | A1 | 11/2018 | Zitzke et al. | |
| 2019/0116882 | A1 | 4/2019 | Ampolini et al. | |
| 2019/0183183 | A1 | 6/2019 | Ito | |
| 2019/0254345 | A1 | 8/2019 | Hepworth et al. | |
| 2020/0008462 | A1 | 1/2020 | Thorens | |
| 2020/0268055 | A1 | 8/2020 | An | |

FOREIGN PATENT DOCUMENTS

| | | | |
|---|---|---|---|
| CN | 207054782 | U | 3/2018 |
| CN | 109661182 | A | 4/2019 |
| CN | 109688854 | A | 4/2019 |
| JP | 2018-523986 | A | 8/2018 |
| JP | 2018-533971 | A | 11/2018 |
| KR | 10-2016-0009022 | A | 1/2016 |
| KR | 10-2017-0140193 | A | 12/2017 |
| KR | 10-2018-0129637 | A | 12/2018 |
| KR | 10-2019-0011724 | A | 2/2019 |
| WO | 2014/180893 | A1 | 11/2014 |
| WO | 2017/093357 | A1 | 6/2017 |
| WO | 2018/050612 | A1 | 3/2018 |

OTHER PUBLICATIONS

International Search Report for PCT/KR2020/006328, dated Sep. 1, 2020.

Communication dated Mar. 27, 2023 issued by the State Intellectual Property Office of the P.R.China in application No. 202080002286.0.

Extended European Search Report dated Jan. 4, 2022 in European Application No. 20774859.1.

Office Action dated Dec. 7, 2021 in Japanese Application No. 2020-558920.

Chinese Office Action dated Sep. 4, 2023 in Application No. 202080002286.0.

* cited by examiner

[Fig. 1]
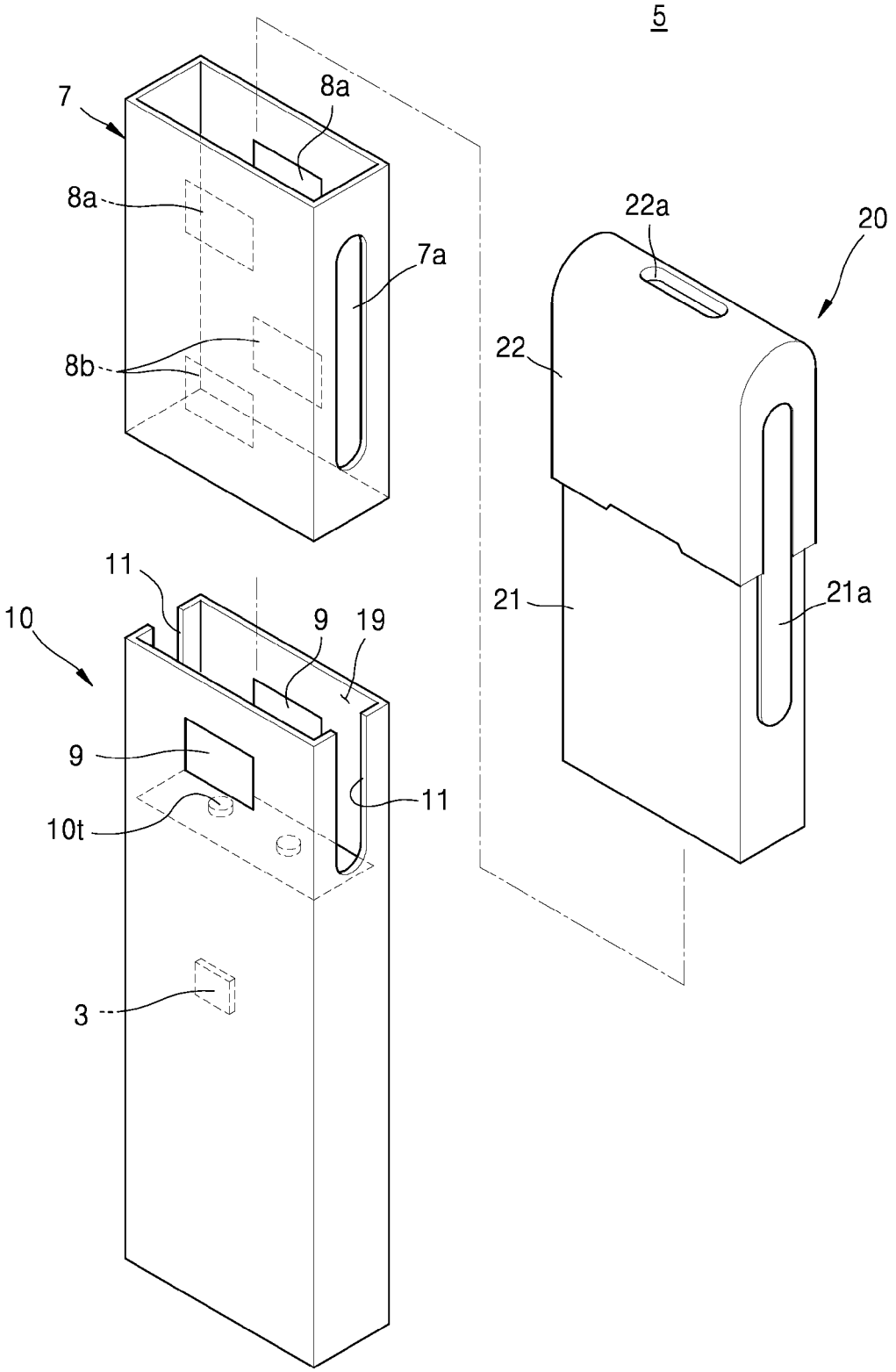

[Fig. 2]
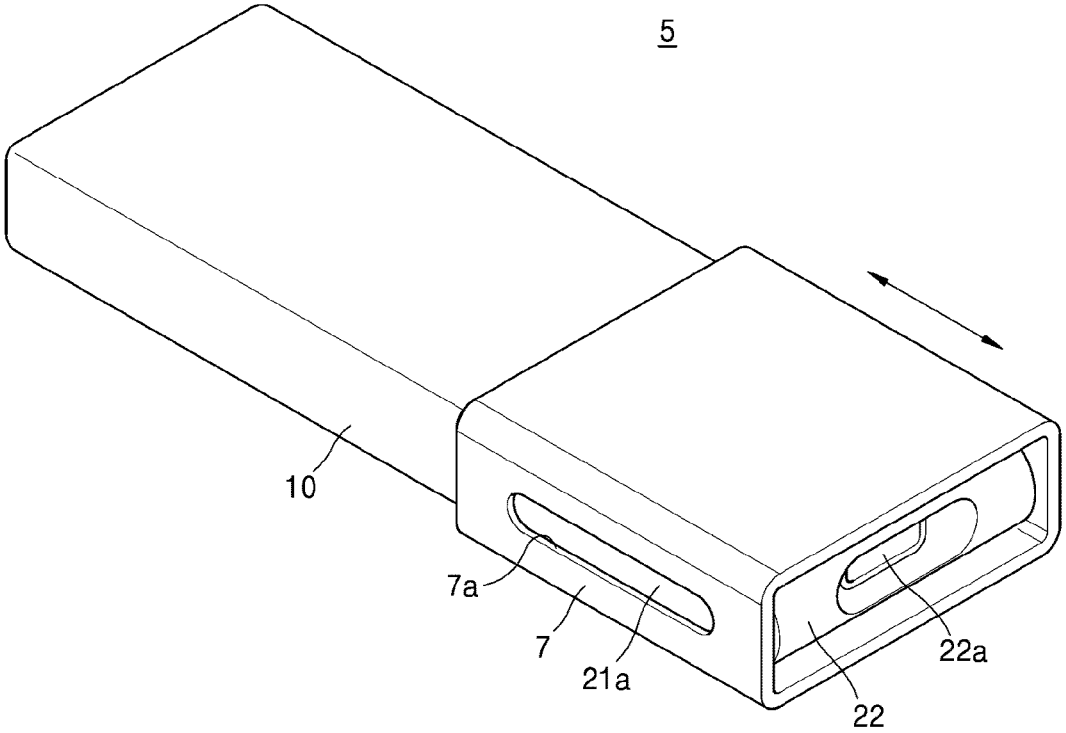
[Fig. 3]
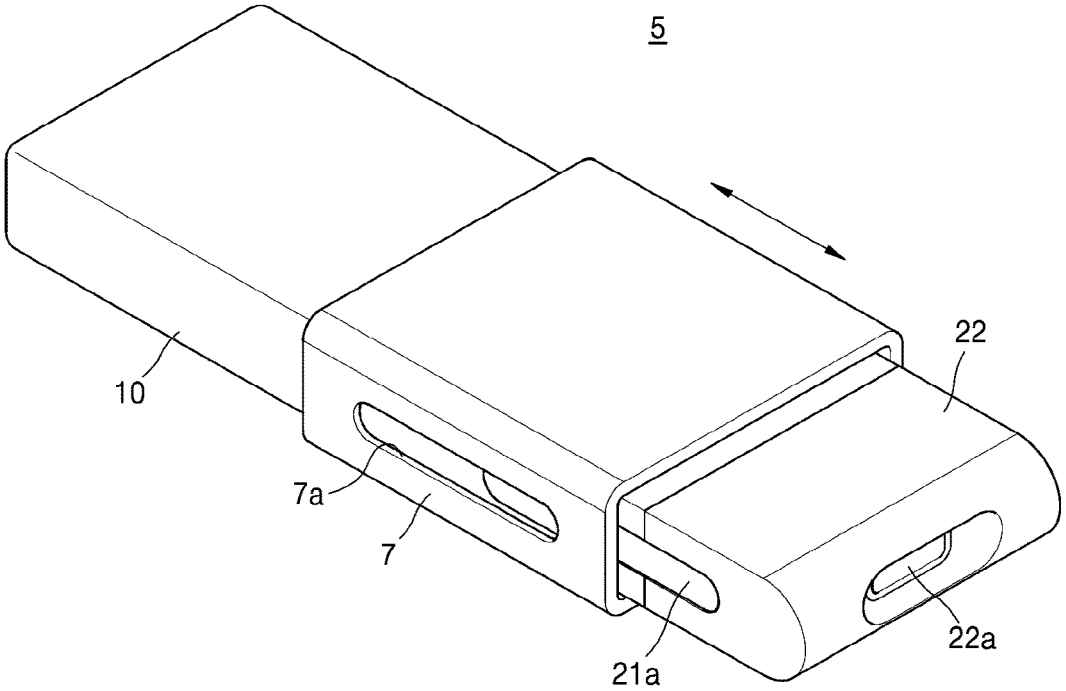

[Fig. 4]
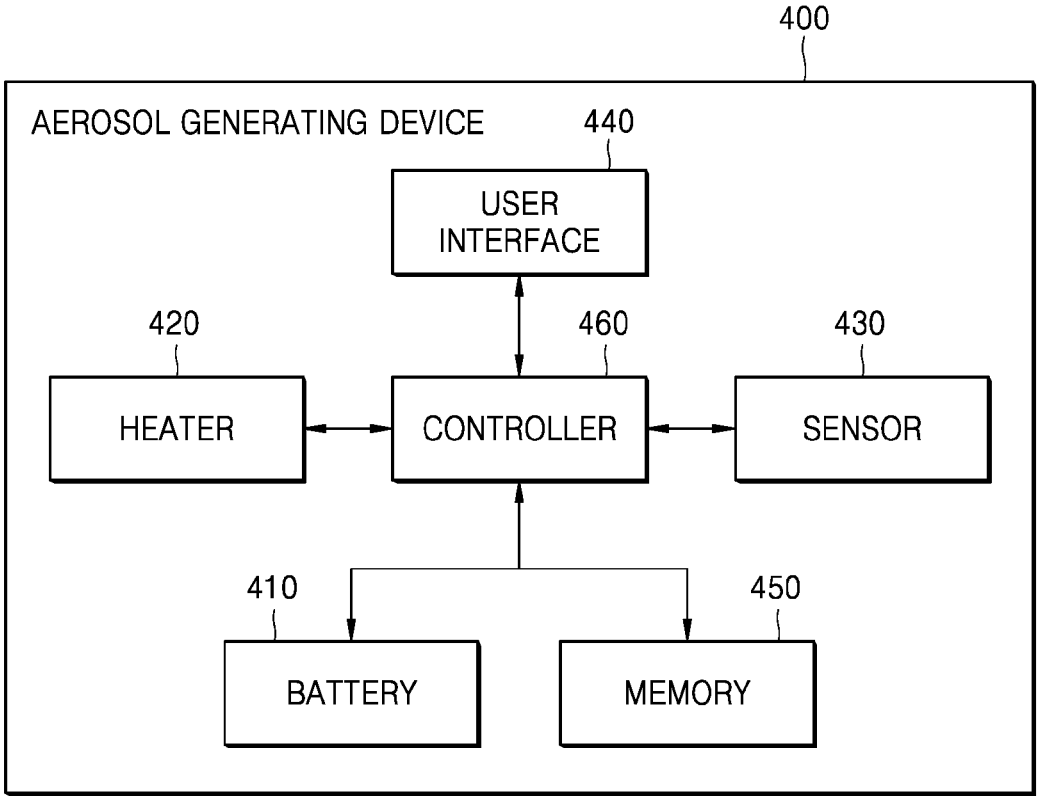
[Fig. 5]
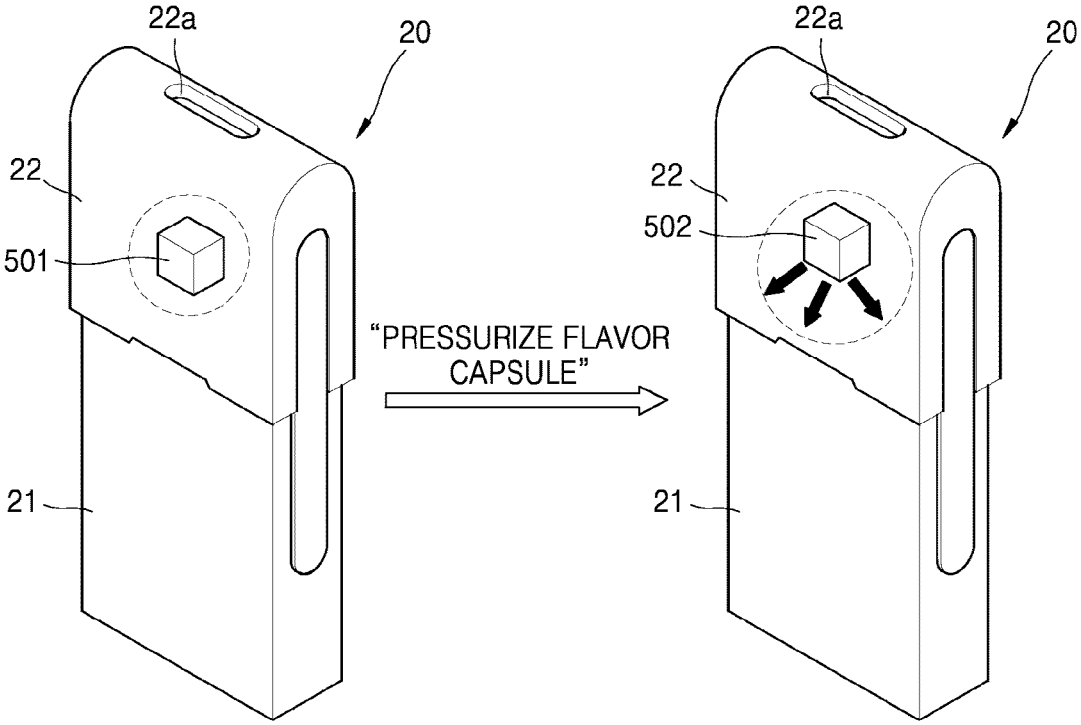

[Fig. 6A]
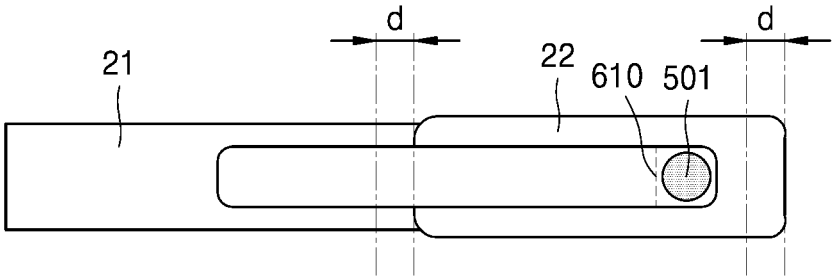
[Fig. 6B]
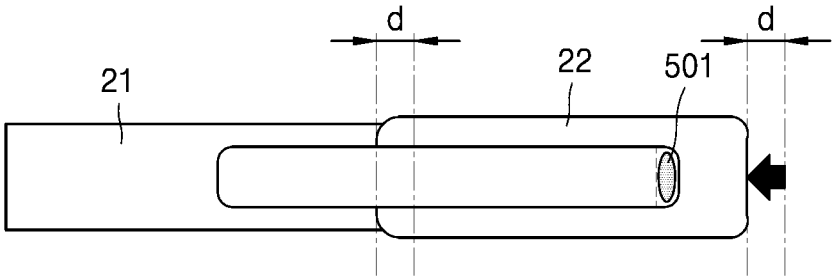
[Fig. 7]
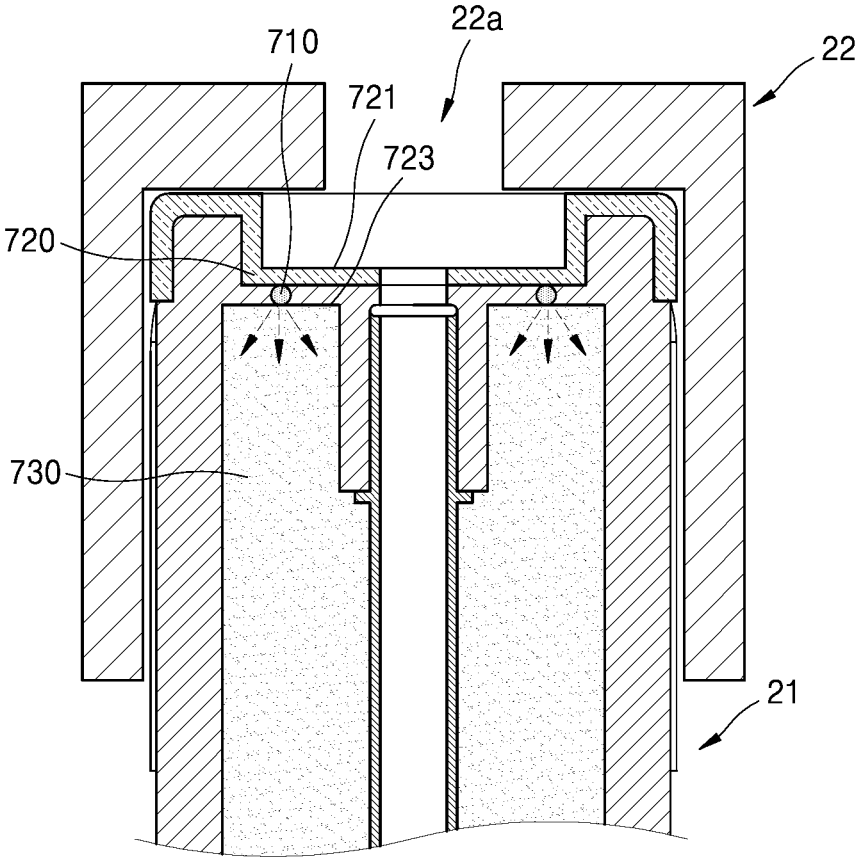

[Fig. 8]
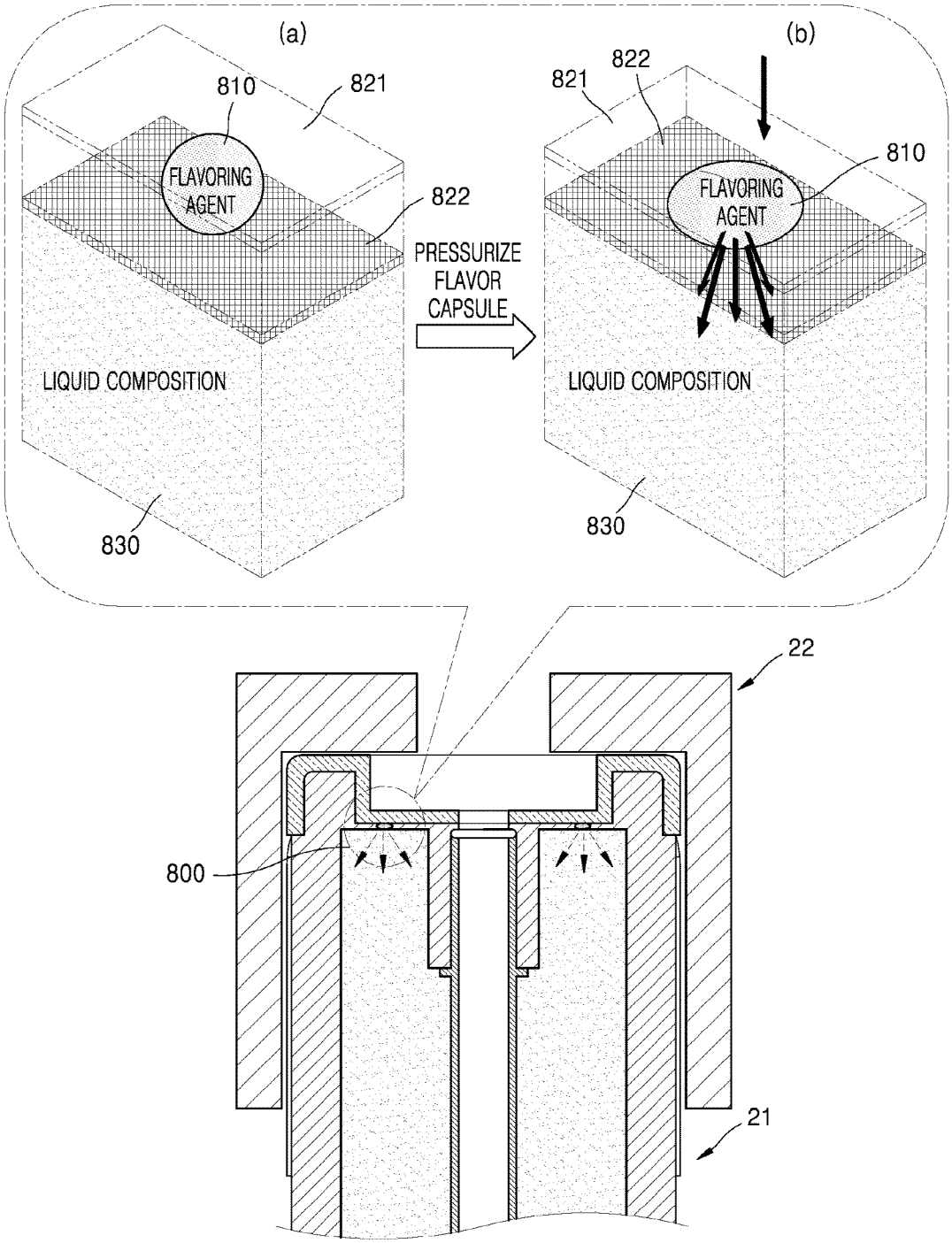

CARTRIDGE FOR AEROSOL GENERATING DEVICE

CROSS REFERENCE TO RELATED APPLICATIONS

This application is a National Stage of International Application No. PCT/KR2020/006328 filed May 14, 2020, claiming priority based on Korean Patent Application No. 10-2019-0092005 filed Jul. 29, 2019.

TECHNICAL FIELD

One or more exemplary embodiments relate to a cartridge for an aerosol generating device.

BACKGROUND ART

Recently, the demand for alternative methods to overcome the shortcomings of general combustive cigarettes has increased, such as a method of generating aerosol by heating an aerosol generating material in cigarettes, rather than by burning cigarettes. Therefore, research into heating-type cigarettes and heating-type aerosol generation devices is being actively carried out.

In the case of an aerosol generating device that generates aerosol by atomizing a liquid composition as an aerosol generating material, a user may purchase or select a cartridge having a liquid composition containing a flavor material of a desired flavor type to smoke. However, even if the user selects the cartridge having the corresponding flavor and smokes, the user may wish to smoke without a separate flavor according to his/her taste. Therefore, for the convenience of the user, there is a need for a cartridge that allows the user to decide whether to add a flavor to the aerosol generated from a liquid composition.

DISCLOSURE OF INVENTION

Solution to Problem

One or more exemplary embodiments include cartridges for aerosol generating devices. The technical solution of the present disclosure is not limited to the above-described technical problems, and other technical problems may be deduced from the following exemplary embodiments.

Additional aspects will be set forth in part in the description which follows and, in part, will be apparent from the description, or may be learned by practice of the presented exemplary embodiments of the disclosure.

According to one or more exemplary embodiments, a cartridge for an aerosol generating device includes a liquid storage provided with a space storing a liquid composition that is atomized by a heater to generate an aerosol and including an open end portion of one side sealed by a sealing means to prevent leakage of the liquid composition stored in the space; a mouthpiece coupled in a direction covering the open end portion of the liquid storage and including a discharge hole through which the aerosol generated from the liquid composition stored in the liquid storage is discharged to an outside; and a flavor capsule provided in a space between the open end portion of the one side of the liquid storage hidden by coupling of the liquid storage and the mouthpiece and the sealing means and crushed due to pressure from a user to discharge a flavoring agent.

Advantageous Effects of Invention

According to the above, a user may decide whether to flavor the aerosol by crushing of a flavor capsule provided in a liquid cartridge when smoking using an aerosol generating device, and thus the convenience of the user may be improved.

BRIEF DESCRIPTION OF DRAWINGS

The above and other aspects, features, and advantages of certain exemplary embodiments of the disclosure will be more apparent from the following description taken in conjunction with the accompanying drawings, in which:

FIG. 1 is an exploded perspective view schematically illustrating a coupling relationship between a replaceable cartridge containing an aerosol generating material and an aerosol generating device including the same, according to an exemplary embodiment.

FIG. 2 is a perspective view of an exemplary operating state of the aerosol generating device according to the exemplary embodiment illustrated in FIG. 1.

FIG. 3 is a perspective view of another exemplary operating state of the aerosol generating device according to the exemplary embodiment illustrated in FIG. 1.

FIG. 4 is a block diagram illustrating hardware components of the aerosol generating device according to an exemplary embodiment.

FIG. 5 is a diagram illustrating the use of a cartridge provided with a flavor capsule according to an exemplary embodiment.

FIGS. 6A and 6B are schematic cross-sectional views of a side surface of a cartridge including a flavor capsule according to an exemplary embodiment.

FIG. 7 is a schematic cross-sectional view of a front surface of a cartridge including a flavor capsule according to an exemplary embodiment.

FIGS. 8A and 8B are diagrams illustrating a space of a cartridge in which a flavor capsule is disposed according to an exemplary embodiment.

BEST MODE FOR CARRYING OUT THE INVENTION

According to one or more exemplary embodiments, a cartridge for an aerosol generating device includes a liquid storage provided with a space storing a liquid composition that is atomized by a heater to generate an aerosol and including an open end portion of one side sealed by a sealing means to prevent leakage of the liquid composition stored in the space; a mouthpiece coupled in a direction covering the open end portion of the liquid storage and including a discharge hole through which the aerosol generated from the liquid composition stored in the liquid storage is discharged to an outside; and a flavor capsule provided in a space between the open end portion of the one side of the liquid storage hidden by coupling of the liquid storage and the mouthpiece and the sealing means and crushed due to pressure from a user to discharge a flavoring agent.

A liquid-permeable material may be provided at the open end portion of the liquid storage, and the flavor capsule is disposed in a space formed between the liquid-permeable material and the sealing means.

The flavoring agent is mixed with the liquid composition by passing through the liquid-permeable material and diffusing into the liquid composition of the liquid storage when the flavor capsule is crushed by the pressure.

The liquid-permeable material is made of a fiber felt of a porous material or a sealing rubber in which one or more perforations are formed.

The pressure is applied when the mouthpiece is pressed toward the liquid storage with a predetermined level of force.

Non-flavored aerosol is generated from the liquid composition when the flavor capsule is not crushed, and flavored aerosol is generated from a mixture of the liquid composition and the flavoring agent when the flavor capsule is crushed.

The flavor capsule may have a spherical or cylindrical shape and include a liquid containing the flavoring agent.

According to one or more exemplary embodiments, an aerosol generating device includes a cartridge including a liquid storage provided with a space storing a liquid composition that is atomized by a heater to generate an aerosol and including an open end portion of one side sealed by a sealing means to prevent leakage of the liquid composition stored in the space, a mouthpiece coupled in a direction covering the open end portion of the liquid storage and including a discharge hole through which the aerosol generated from the liquid composition stored in the liquid storage is discharged to an outside, and a flavor capsule provided in a space between the open end portion of the one side of the liquid storage hidden by coupling of the liquid storage and the mouthpiece and the sealing means and crushed due to pressure from a user to discharge a flavoring agent; and a main body provided with a space for accommodating the cartridge and including a puff detection sensor configured to detect a puff of a user, and a controller configured to control generation of the aerosol based on results of sensing by the puff detection sensor.

MODE FOR THE INVENTION

Reference will now be made in detail to exemplary embodiments, examples of which are illustrated in the accompanying drawings, wherein like reference numerals refer to like elements throughout. In this regard, the present exemplary embodiments may have different forms and should not be construed as being limited to the descriptions set forth herein. Accordingly, the exemplary embodiments are merely described below, by referring to the figures, to explain aspects of the present description. As used herein, the term "and/or" includes any and all combinations of one or more of the associated listed items. Expressions such as "at least one of," when preceding a list of elements, modify the entire list of elements and do not modify the individual elements of the list.

With respect to the terms used to describe the various exemplary embodiments, general terms which are currently and widely used are selected in consideration of functions of structural elements in the various exemplary embodiments of the present disclosure. However, meanings of the terms can be changed according to intention, a judicial precedence, the appearance of new technology, and the like. In addition, in certain cases, a term which is not commonly used can be selected. In such a case, the meaning of the term will be described in detail at the corresponding portion in the description of the present disclosure. Therefore, the terms used in the various exemplary embodiments of the present disclosure should be defined based on the meanings of the terms and the descriptions provided herein.

In addition, unless explicitly described to the contrary, the word "comprise" and variations such as "comprises" or "comprising" will be understood to imply the inclusion of stated elements but not the exclusion of any other elements. In addition, the terms "-er", "-or", and "module" described in the specification mean units for processing at least one function and/or operation and can be implemented by hardware components or software components and combinations thereof.

Hereinafter, the present disclosure will now be described more fully with reference to the accompanying drawings, in which exemplary embodiments of the present disclosure are shown such that one of ordinary skill in the art may easily work the present disclosure. The disclosure may, however, be embodied in many different forms and should not be construed as being limited to the exemplary embodiments set forth herein.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over," "directly above," "directly on," "directly connected to" or "directly coupled to" another element or layer, there are no intervening elements or layers present. Like numerals refer to like elements throughout.

FIG. 1 is an exploded perspective view schematically illustrating a coupling relationship between a replaceable cartridge containing an aerosol generating material and an aerosol generating device, according to an exemplary embodiment.

An aerosol generating device 5 according to the exemplary embodiment illustrated in FIG. 1 includes the cartridge 20 containing the aerosol generating material and a main body 10 supporting the cartridge 20.

The cartridge 20 containing the aerosol generating material may be coupled to the main body 10. A portion of the cartridge 20 may be inserted into an accommodation space 19 of the main body 10 so that the cartridge 20 is mounted on the main body 10.

The cartridge 20 may contain an aerosol generating material that is in, for example, a liquid state, a solid state, a gaseous state, or a gel state. The aerosol generating material may include a liquid composition. For example, the liquid composition may be a liquid including a tobacco-containing material having a volatile tobacco flavor component, or a liquid including a non-tobacco material.

For example, the liquid composition may include any weight ratio of glycerin and propylene glycol solution to which nicotine salts are added. The liquid composition may include two or more types of nicotine salts. Nicotine salts may be formed by adding suitable acids, including organic or inorganic acids, to nicotine that may be natural or synthetic. Nicotine may have a suitable weight concentration relative to the total solution weight of the liquid composition.

Acid used in forming the nicotine salts may be appropriately selected in consideration of the rate of nicotine absorption in the blood, the operating temperature of the aerosol generating device 5, the flavor or savor, the solubility, or the like. For example, the acid may be a single acid selected from the group consisting of benzoic acid, lactic acid, salicylic acid, lauric acid, sorbic acid, levulinic acid, pyruvic acid, formic acid, acetic acid, propionic acid, butyric acid, valeric acid, caproic acid, caprylic acid, capric acid, citric acid, myristic acid, palmitic acid, stearic acid, oleic acid, linoleic acid, linolenic acid, phenylacetic acid, tartaric acid, succinic acid, fumaric acid, gluconic acid, saccharic acid, malonic acid, and malic acid, or may be a mixture of two or more acids selected from the above group, but is not limited thereto.

The cartridge 20 may be operated by an electrical signal or a wireless signal transmitted from the main body 10 to perform a function of generating aerosol by converting the phase of the aerosol generating material inside the cartridge 20 to a gaseous phase. The aerosol may refer to a gas in which vaporized particles generated from an aerosol generating material are mixed with air.

For example, in response to receiving the electrical signal from the main body 10, the cartridge 20 may convert the phase of the aerosol generating material by heating the aerosol generating material using, for example, an ultrasonic vibration method or an induction heating method. As another example, the cartridge 20 may include its own power source and generate aerosol based on an electric control signal or a wireless signal received from the main body 10.

The cartridge 20 may include a liquid storage 21 accommodating the aerosol generating material therein, and an atomizer performing a function of converting the aerosol generating material of the liquid storage 21 to aerosol.

When the liquid storage 21 "accommodates the aerosol generating material" therein, it means that the liquid storage 21 functions as a container simply holding an aerosol generating material. The liquid storage 21 may include an element impregnated with (i.e., containing) an aerosol generating material, such as a sponge, cotton, fabric, or porous ceramic structure.

The atomizer may include, for example, a liquid delivery element (e.g., wick) for absorbing the aerosol generating material and maintaining the same in an optimal state for conversion to aerosol, and a heater heating the liquid delivery element to generate aerosol.

The liquid delivery element may include at least one of, for example, a cotton fiber, a ceramic fiber, a glass fiber, and porous ceramic.

The heater may include a metallic material such as copper, nickel, tungsten, or the like to heat the aerosol generating material delivered to the liquid delivery element, by generating heat using electrical resistance. The heater may be implemented by, for example, a metal wire, a metal plate, a ceramic heating element, or the like. Also, the heater may be implemented by a conductive filament using a material such as a nichrome wire, and may be wound around or arranged adjacent to the liquid delivery element.

In addition, the atomizer may be implemented by a heating element in the form of a mesh or plate, which absorbs the aerosol generating material and maintains the same in an optimal state for conversion to aerosol, and generates aerosol by heating the aerosol generating material. In this case, a separate liquid delivery element may not be required.

At least a portion of the liquid storage 21 of the cartridge 20 may include a transparent portion so that the aerosol generating material accommodated in the cartridge 20 may be visually identified from the outside. The liquid storage 21 may include a protruding window 21*a* protruding from the liquid storage 21, so that the liquid storage 21 may be inserted into a groove 11 of the main body 10 when coupled to the main body 10. A mouthpiece 22 and/or the liquid storage 21 may be entirely formed of transparent plastic or glass. Alternatively, only the protruding window 21*a* may be formed of a transparent material.

The main body 10 includes a connection terminal 10*t* arranged inside the accommodation space 19. When the liquid storage 21 of the cartridge 20 is inserted into the accommodation space 19 of the main body 10, the main body 10 may provide power to the cartridge 20 or supply a signal related to an operation of the cartridge 20 to the cartridge 20, through the connection terminal 10*t*.

The mouthpiece 22 is coupled to one end of the liquid storage 21 of the cartridge 20. The mouthpiece 22 is a portion of the aerosol generating device 5, which is to be inserted into a user's mouth. The mouthpiece 22 includes a discharge hole 22*a* for discharging aerosol generated from the aerosol generating material inside the liquid storage 21 to the outside.

The slider 7 is coupled to the main body 10 to move with respect to the main body 10. The slider 7 covers or exposes at least a portion of the mouthpiece 22 of the cartridge 20 coupled to the main body 10 by moving with respect to the main body 10. The slider 7 includes an elongated hole 7*a* exposing at least a portion of the protruding window 21*a* of the cartridge 20 to the outside.

As shown FIG. 1, the slider 7 may have a shape of a hollow container with both ends opened, but the structure of the slider 7 is not limited thereto. For example, the slider 7 may have a bent plate structure having a clip-shaped cross-section, which is movable with respect to the main body 10 while being coupled to an edge of the main body 10. In another example, the slider 7 may have a curved semi-cylindrical shape with a curved arc-shaped cross section.

The slider 7 may include a magnetic body for maintaining the position of the slider 7 with respect to the main body 10 and the cartridge 20. The magnetic body may include a permanent magnet or a material such as iron, nickel, cobalt, or an alloy thereof.

The magnetic body may include two first magnetic bodies 8*a* facing each other, and two second magnetic bodies 8*b* facing each other. The first magnetic bodies 8*a* are arranged to be spaced apart from the second magnetic bodies 8*b* in a longitudinal direction of the main body 10 (i.e., the direction in which the main body 10 extends), which is a moving direction of the slider 7.

The main body 10 includes a fixed magnetic body 9 arranged on a path along which the first magnetic bodies 8*a* and the second magnetic bodies 8*b* of the slider 7 move as the slider 7 moves with respect to the main body 10. Two fixed magnetic bodies 9 of the main body 10 may be mounted facing each other with the accommodation space 19 therebetween.

The slider 7 may be stably maintained in positions where an end of the mouthpiece 22 is covered or exposed, by magnetic force acting between the fixed magnetic body 9 and the first magnetic body 8*a* or between the fixed magnetic body 9 and the second magnetic body 8*b*.

The main body 10 includes a position change detecting sensor 3 arranged on the path along which the first magnetic body 8*a* and the second magnetic body 8*b* of the slider 7 move as the slider 7 moves with respect to the main body 10. The position change detecting sensor 3 may include, for example, a Hall integrated circuit (IC) that uses the Hall effect to detect a change in a magnetic field, and generate a signal based on the detected change.

In the aerosol generating device 5 according to the above-described exemplary embodiments, the main body 10, the cartridge 20, and the slider 7 have approximately rectangular cross-sectional shapes when viewed in the longitudinal direction, but in the exemplary embodiments, the shape of the aerosol generating device 5 is not limited. The aerosol generating device 5 may have, for example, a cross-sectional shape of a circle, an ellipse, a square, or various polygonal shapes. In addition, the aerosol generating device 5 is not necessarily limited to a structure that extends linearly, and may be curved in a streamlined shape or bent at a preset angle to be easily held by the user.

FIG. 2 is a perspective view of an exemplary operating state of the aerosol generating device according to the exemplary embodiment illustrated in FIG. 1.

In FIG. 2, the slider 7 is moved to a position where the end of the mouthpiece 22 of the cartridge 20 coupled to the main body 10 is covered. In this state, the mouthpiece 22 may be safely protected from external impurities and kept clean.

The user may check the remaining amount of aerosol generating material contained in the cartridge 20 by looking at the protruding window 21*a* of the cartridge 20 through the elongated hole 7*a* of the slider 7. The user may move the slider 7 in the longitudinal direction of the main body 10 to use the aerosol generating device 5.

FIG. 3 is a perspective view of another exemplary operating state of the aerosol generating device according to the exemplary embodiment illustrated in FIG. 1.

In FIG. 3, the operating state is shown in which the slider 7 is moved to a position where the end of the mouthpiece 22 of the cartridge 20 coupled to the main body 10 is exposed to the outside. In this state, the user may insert the mouthpiece 22 into his or her mouth and inhale aerosol discharged through the discharge hole 22*a* of the mouthpiece 22.

As shown in FIG. 3, the protruding window 21*a* of the cartridge 20 is still exposed to the outside through the elongated hole 7*a* of the slider 7 when the slider 7 is moved to the position where the end of the mouthpiece 22 is exposed to the outside. Thus, the user may be able to check the remaining amount of aerosol generating material contained in the cartridge 20, regardless of the position of the slider 7.

FIG. 4 is a block diagram illustrating components of the aerosol generating device according to an exemplary embodiment.

Referring to FIG. 4, the aerosol generating device 400 may include a battery 410, a heater 420, a sensor 430, a user interface 440, a memory 450, and a controller 460. However, the internal structure of the aerosol generating device 400 is not limited to the structures illustrated in FIG. 4. Also, it will be understood by one of ordinary skill in the art that some of the hardware components shown in FIG. 4 may be omitted or new components may be added according to the design of the aerosol generating device 400.

In an exemplary embodiment where the aerosol generating device 400 includes a main body without a cartridge, the components shown in FIG. 4 may be located in the main body. In another exemplary embodiment where the aerosol generating device 400 includes a main body and a cartridge, the components shown in FIG. 4 may be located in the main body and/or the cartridge.

The battery 410 supplies electric power to be used for the aerosol generating device 400 to operate. For example, the battery 410 may supply power such that the heater 420 may be heated. In addition, the battery 410 may supply power required for operation of other components of the aerosol generating device 400, such as the sensor 430, the user interface 440, the memory 450, and the controller 460. The battery 410 may be a rechargeable battery or a disposable battery. For example, the battery 410 may be a lithium polymer (LiPoly) battery, but is not limited thereto.

The heater 420 receives power from the battery 410 under the control of the controller 460. The heater 420 may receive power from the battery 410 and heat a cigarette inserted into the aerosol generating device 400, or heat the cartridge mounted on the aerosol generating device 400.

The heater 420 may be located in the main body of the aerosol generating device 400. Alternatively, the heater 420 may be located in the cartridge. When the heater 420 is located in the cartridge, the heater 420 may receive power from the battery 410 located in the main body and/or the cartridge.

The heater 420 may be formed of any suitable electrically resistive material. For example, the suitable electrically resistive material may be a metal or a metal alloy including titanium, zirconium, tantalum, platinum, nickel, cobalt, chromium, hafnium, niobium, molybdenum, tungsten, tin, gallium, manganese, iron, copper, stainless steel, or nichrome, but is not limited thereto. In addition, the heater 420 may be implemented by a metal wire, a metal plate on which an electrically conductive track is arranged, or a ceramic heating element, but is not limited thereto.

In an exemplary embodiment, the heater 420 may be included in the cartridge. The cartridge may include the heater 420, the liquid delivery element, and the liquid storage. The aerosol generating material accommodated in the liquid storage may be absorbed by the liquid delivery element, and the heater 420 may heat the aerosol generating material absorbed by the liquid delivery element, thereby generating aerosol. For example, the heater 420 may include a material such as nickel or chromium and may be wound around or arranged adjacent to the liquid delivery element.

In another exemplary embodiment, the heater 420 may heat the cigarette inserted into the accommodation space of the aerosol generating device 400. When the cigarette is accommodated in the accommodation space of the aerosol generating device 400, the heater 420 may be located inside and/or outside the cigarette and generate aerosol by heating the aerosol generating material in the cigarette.

Meanwhile, the heater 420 may include an induction heater. The heater 430 may include an electrically conductive coil for heating a cigarette or the cartridge by an induction heating method, and the cigarette or the cartridge may include a susceptor which may be heated by the induction heater.

The aerosol generating device 400 may include at least one sensor 430. A result sensed by the at least one sensor 430 is transmitted to the controller 460, and the controller 460 may control the aerosol generating device 400 by controlling the operation of the heater, restricting smoking, determining whether a cigarette (or a cartridge) is inserted, displaying a notification, etc.

For example, the sensor 430 may include a puff detecting sensor. The puff detecting sensor may detect a user's puff based on a temperature change, a flow change, a voltage change, and/or a pressure change.

The sensor 430 may include a temperature sensor. The temperature sensor may detect a temperature of the heater 420 (or an aerosol generating material). The aerosol generating device 400 may include a separate temperature sensor for sensing a temperature of the heater 420, or the heater 420 itself may serve as a temperature sensor without a separate temperature sensor. Alternatively, an additional temperature sensor may be further included in the aerosol generating device 400 even the heater 420 may serve as a temperature sensor.

The sensor 430 may include a position change detecting sensor. The position change detecting sensor may detect a change in a position of the slider which is coupled to the main body and slides along the main body.

The user interface 440 may provide the user with information about the state of the aerosol generating device 400. For example, the user interface 440 may include a display or a light emitter for outputting visual information, a motor for outputting haptic information, a speaker for outputting sound information, input/output (I/O) interfacing devices (for example, a button or a touch screen) for receiving information input from the user or outputting information to the user, terminals for performing data communication or receiving charging power, and/or communication interfacing modules for performing wireless communication (for example, Wi-Fi, Wi-Fi direct, Bluetooth, near-field communication (NFC), etc.) with external devices.

The memory 450 may store various data processed or to be processed by the controller 460. The memory 450 may include various types of memories, such as dynamic random access memory (DRAM), static random access memory (SRAM), read-only memory (ROM), electrically erasable programmable read-only memory (EEPROM), etc.

For example, the memory 450 may store an operation time of the aerosol generating device 400, the maximum number of puffs, the current number of puffs, at least one temperature profile, data on a user's smoking pattern, etc.

The controller 460 may control overall operations of the aerosol generating device 400. The controller 460 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor can be implemented in other forms of hardware.

The controller 460 analyzes a result of the sensing by at least one sensor 430, and controls processes that are to be performed subsequently.

The controller 460 may control power supplied to the heater 420 so that the operation of the heater 420 is started or terminated, based on the result of the sensing by the sensor 430. In addition, based on the result of the sensing by the sensor 430, the controller 460 may control the amount of power supplied to the heater 420 and the time at which the power is supplied, so that the heater 420 is heated to a predetermined temperature and/or maintained at an appropriate temperature.

The controller 460 may control the user interface 440 based on the result of the sensing by the at least one sensor 430. For example, when the number of user's puffs counted by the puff detecting sensor reaches a preset number, the controller 460 may notify the user by using the user interface 440 (e.g., a light emitter, a motor or a speaker, etc.) that the operation of the aerosol generating device 400 will soon be terminated.

Although not illustrated in FIG. 4, the aerosol generating device 400 may be coupled to a separate cradle to form an aerosol generating system. For example, the cradle may be used to charge the battery 410 of the aerosol generating device 400. For example, the aerosol generating device 400 may be supplied with power from a battery of the cradle to charge the battery 410 of the aerosol generating device 400 while being accommodated in an accommodation space of the cradle.

FIG. 5 is a diagram illustrating a cartridge 20 provided with a flavor capsule 501 according to an exemplary embodiment.

Referring to FIG. 5, the separate flavor capsule 501 including a flavoring agent may be provided inside the cartridge 20. The flavoring agent of the flavor capsule 501 may be a material for adding flavor to the aerosol generated when a liquid composition (i.e., an aerosol generating material) stored in the liquid storage 21 is atomized.

The flavor capsule 501 may be a spherical or cylindrical shape capsule in which a liquid containing the flavoring agent is included. However, the shape of the flavor capsule 501 is not limited thereto and may be implemented in various ways.

The liquid composition stored in the liquid storage 21 of the cartridge 20 may not include a separate flavoring agent component. However, a user may apply pressure to the mouthpiece 22 of the cartridge 20 such that the flavor capsule 501 is crushed. As such, the flavoring agent contained in the flavor capsule 501 may be discharged into the liquid composition.

As a result, the liquid composition and the flavoring agent are mixed, and atomization of the mixture may generate flavored aerosol.

The flavoring agent may include water, a solvent, ethanol, plant extract, spices, flavoring agents, and/or a vitamin mixture. For example, the spices may include menthol, peppermint, spearmint oil, and various fruit-flavored ingredients, but are not limited thereto. That is, the flavoring agent may be an ingredient capable of providing various flavors or tastes to the user.

Meanwhile, the user may inhale non-flavored aerosol by not crushing the flavor capsule 501. That is, the user may select whether to flavor the aerosol according to his/her taste in aerosol inhalation using the cartridge 20.

The crushing of the flavor capsule 501 included in the cartridge 20 may be performed before or after the cartridge 20 is received in the main body 10. Further, the user may crush the flavor capsule 501 in the middle of smoking.

FIGS. 6A and 6B are schematic cross-sectional views of a side surface of a cartridge including the flavor capsule 501 according to an exemplary embodiment.

Referring to FIG. 6A, the flavor capsule 501 may be provided in a space formed between the liquid storage 21 and the mouthpiece 22. A liquid-permeable material 610 may be provided between the flavor capsule 501 and a space for storing the liquid composition of the liquid storage 21

As shown in FIG. 6B, when a user moves the mouthpiece 22 *a* distance d toward the liquid storage 21, the flavor capsule 501 may be crushed. The crush strength for crushing the flavor capsule 501 may be, for example, about 1.5 Kgf, but is not limited thereto, and various crush strength conditions may be used.

In FIG. 6B, the user presses the mouthpiece 22 toward the liquid storage 21, but it may be readily understood that the flavor capsule 501 may be crushed when the user presses the liquid storage 21 toward the mouthpiece 22.

FIG. 7 is a schematic cross-sectional view of a front surface of a cartridge including a flavor capsule according to an exemplary embodiment.

Referring to FIG. 7, the liquid storage 21 is provided with a space 730 storing a liquid composition that is atomized by a heater to generate aerosol. The open end portion 723 of the liquid storage 21 is sealed by a sealing means 720 so as to prevent leakage of the liquid composition stored in the space 730.

Meanwhile, the mouthpiece 22 including a discharge hole 22*a* for discharging the aerosol generated from the liquid composition stored in the liquid storage 21 to the outside may be coupled to the liquid storage 21 such that the open end portion 723 of the liquid storage 21 is covered by the mouthpiece 22.

The flavor capsule 710 may be provided in a space between the open end portion 723 of the liquid storage 21, which is hidden by coupling of the liquid storage 21 and the mouthpiece 22, and the sealing means 720. A liquid-permeable material may be provided at the open end portion 723 of the liquid storage 21.

The sealing means 720 may be manufactured of sealing rubber, but is not limited thereto, and may be any material as long as it is suitable for preventing leakage from the liquid storage 21.

A flavoring agent discharged from the crushed flavor capsule 710 may pass through a surface of a liquid-permeable material provided at the open end portion 723 of the liquid storage 21 and diffuse to the liquid composition in the space 730 of the liquid storage 21 such that the flavoring agent may be mixed into the liquid composition.

When the mixture of the liquid composition and a flavoring agent is heated by a heater, flavored aerosol may be generated. The flavored aerosol may be provided to the user through the discharge hole 22*a* of the mouthpiece 22.

FIGS. 8A and 8B are diagrams illustrating a space 800 of the cartridge 20 in which a flavor capsule 810 is disposed according to an exemplary embodiment.

Referring to FIGS. 8A and 8B, enlarged diagrams of the space 800 of the cartridge 20 (of FIG. 1) in which the flavor capsule 810 is disposed are illustrated. FIG. 8A illustrates a state before the flavor capsule 810 is crushed in the space 800, and FIG. 8B illustrates a state after the flavor capsule 810 is crushed in the space 800.

The flavor capsule 810 is disposed in the space 800 formed between the liquid-permeable material 822 provided at the open end portion 723 (see FIG. 7) of the liquid storage 21 (see FIG. 7) and the scaling rubber 821. Here, the liquid-permeable material 822 may be implemented by a fiber felt of a porous material, sealing rubber in which one or more perforations are formed, a planar plastic in which perforations are formed, metal, etc.

When an interval between the liquid-permeable material 822 and the sealing rubber 821 is narrowed due to pressure from the user, the flavor capsule 810 may be crushed. Thus, a flavoring agent contained inside the flavor capsule 810 may be discharged to the outside. Because the liquid-permeable material 822 is in direct contact with the space 830 containing a liquid composition, the flavoring agent discharged from the flavor capsule 810 passes through the liquid-permeable material 822 and diffuses into the liquid composition in the space 830 of the liquid storage 21. As a result, the flavoring agent may be mixed into the liquid composition.

Meanwhile, because the sealing rubber 821 is a liquid-impermeable material, the flavoring agent of the crushed flavor capsules 810 may be discharged only in one direction passing through the liquid-permeable material 822.

When the user inhales the aerosol through the discharge hole 22*a* of the mouthpiece 22 without crushing the flavor capsule 810 as shown in (a) of FIG. 8, the user may inhale non-flavored aerosol generated from the liquid composition. On the other hand, when the user inhales the aerosol through the discharge hole 22*a* of the mouthpiece 22 after the flavor capsule 810 is crushed as shown in (b) of FIG. 8, the user may inhale flavored aerosol generated from the mixture of the liquid composition and the flavoring agent. That is, the user may decide whether to flavor the aerosol when smoking using the aerosol generating device 5, and thus the convenience of the user may be improved.

According to the above, a user may decide whether to flavor the aerosol by crushing of a flavor capsule provided in a liquid cartridge when smoking using an aerosol generating device, and thus the convenience of the user may be improved.

At least one of the components, elements, modules or units (collectively "components" in this paragraph) represented by a block in the drawings such as the sensor 430, the user interface 440, and the controller 460 in FIG. 4 may be embodied as various numbers of hardware, software and/or firmware structures that execute respective functions described above, according to an exemplary embodiment. For example, at least one of these components may use a direct circuit structure, such as a memory, a processor, a logic circuit, a look-up table, etc. that may execute the respective functions through controls of one or more microprocessors or other control apparatuses. Also, at least one of these components may be specifically embodied by a module, a program, or a part of code, which contains one or more executable instructions for performing specified logic functions, and executed by one or more microprocessors or other control apparatuses. Further, at least one of these components may include or may be implemented by a processor such as a central processing unit (CPU) that performs the respective functions, a microprocessor, or the like. Two or more of these components may be combined into one single component which performs all operations or functions of the combined two or more components. Also, at least part of functions of at least one of these components may be performed by another of these components. Further, although a bus is not illustrated in the above block diagrams, communication between the components may be performed through the bus. Functional aspects of the above exemplary embodiments may be implemented in algorithms that execute on one or more processors. Furthermore, the components represented by a block or processing steps may employ any number of related art techniques for electronics configuration, signal processing and/or control, data processing and the like.

It should be understood that exemplary embodiments described herein should be considered in a descriptive sense only and not for purposes of limitation. Descriptions of features or aspects within each exemplary embodiment should typically be considered as available for other similar features or aspects in other exemplary embodiments. While one or more exemplary embodiments have been described with reference to the figures, it will be understood by those of ordinary skill in the art that various changes in form and details may be made therein without departing from the spirit and scope of the disclosure as defined by the following claims.

The invention claimed is:

1. A cartridge for an aerosol generating device, the cartridge comprising:

a liquid storage provided with a space storing a liquid composition that is atomized by a heater to generate an aerosol and comprising an open end portion of one side sealed by a sealing means to prevent leakage of the liquid composition stored in the space;

a mouthpiece coupled in a direction covering the open end portion of the liquid storage and comprising a discharge hole through which the aerosol generated from the liquid composition stored in the liquid storage is discharged to an outside; and a flavor capsule provided in a space between the open end portion of the one side of the liquid storage hidden by coupling of the liquid storage and the mouthpiece and the sealing means and crushed due to pressure from a user to discharge a flavoring agent.

2. The cartridge of claim 1, wherein a liquid-permeable material is provided at the open end portion of the liquid storage, and the flavor capsule is disposed in a space formed between the liquid-permeable material and the sealing means.

3. The cartridge of claim 2, wherein the flavoring agent is mixed with the liquid composition by passing through the liquid-permeable material and diffusing into the liquid composition of the liquid storage when the flavor capsule is crushed by the pressure.

4. The cartridge of claim 2, wherein the liquid-permeable material is made of a fiber felt of a porous material or a sealing rubber in which one or more perforations are formed.

5. The cartridge of claim 1, wherein the pressure is applied when the mouthpiece is pressed toward the liquid storage with a predetermined level of force.

6. The cartridge of claim 1, wherein non-flavored aerosol is generated from the liquid composition when the flavor capsule is not crushed, and flavored aerosol is generated from a mixture of the liquid composition and the flavoring agent when the flavor capsule is crushed.

7. The cartridge of claim 1, wherein the flavor capsule has a spherical or cylindrical shape and includes a liquid containing the flavoring agent.

8. An aerosol generating device comprising:

a cartridge comprising:

a liquid storage provided with a space storing a liquid composition that is atomized by a heater to generate an aerosol and comprising an open end portion of one side sealed by a sealing means to prevent leakage of the liquid composition stored in the space, a mouthpiece coupled in a direction covering the open end portion of the liquid storage and comprising a discharge hole through which the aerosol generated from the liquid composition stored in the liquid storage is discharged to an outside, and a flavor capsule provided in a space between the open end portion of the one side of the liquid storage hidden by coupling of the liquid storage and the mouthpiece and the sealing means and crushed due to pressure from a user to discharge a flavoring agent; and a main body provided with a space for accommodating the cartridge and comprising:

a puff detection sensor configured to detect a puff of a user; and a controller configured to control generation of the aerosol based on results of sensing by the puff detection sensor.

* * * * *